United States Patent [19]

Stahl et al.

[11] 4,417,897

[45] Nov. 29, 1983

[54] PROCESS FOR PREPARING BURN-OUT EFFECTS ON TEXTILE MATERIALS

[75] Inventors: Theo Stahl, Frankfurt am Main; Ulrich Bühler, Schöneck, both of Fed. Rep. of Germany

[73] Assignee: Cassella Aktiengesellschaft, Frankfurt am Main, Fed. Rep. of Germany

[21] Appl. No.: 473,784

[22] Filed: Mar. 10, 1983

[30] Foreign Application Priority Data

Mar. 15, 1982 [DE] Fed. Rep. of Germany ..... 3209329

[51] Int. Cl.[3] ..... D06P 5/15; D06C 23/02

[52] U.S. Cl. ..... 8/464; 8/114.6; 8/478; 8/481; 8/503; 8/532

[58] Field of Search ..... 8/481, 503, 532, 464, 8/114.6, 478

[56] References Cited

U.S. PATENT DOCUMENTS

| | | | |
|---|---|---|---|
| 2,322,322 | 6/1943 | Seymour et al. | 8/464 |
| 2,322,323 | 6/1943 | Seymour et al. | 8/464 |
| 3,743,478 | 7/1973 | Sando et al. | 8/114.6 |
| 4,265,629 | 5/1981 | Ribka et al. | 8/449 |
| 4,322,213 | 3/1982 | Tappe et al. | 8/464 |
| 4,386,935 | 6/1983 | Buhler et al. | 8/464 |

FOREIGN PATENT DOCUMENTS

| | | | |
|---|---|---|---|
| 49-42999 | 4/1974 | Japan | 8/503 |

*Primary Examiner*—A. Lionel Clingman
*Attorney, Agent, or Firm*—Connolly and Hutz

[57] ABSTRACT

An improved process for preparing white or colored burn-out effects on textile materials containing hydrophobic fibers and cellulose fibers which process comprises applying to the material a dyeing liquor or printing paste containing at least one disperse dyestuff for dyeing the hydrophobic fibers alone or mixed with dyestuff for dyeing the cellulose fibers, applying a burn-out agent to the textile material in the form of a pattern, and then heat-treating the textile material at about 100° to 240° C. whereby the dyestuff is fixed and the burnout effect is produced, wherein the improvement comprises said dyeing liquor or print paste contains at least one disperse dyestuff which is discharged by the burn-out agent.

12 Claims, No Drawings

PROCESS FOR PREPARING BURN-OUT EFFECTS ON TEXTILE MATERIALS

The invention relates to a process for preparing white or coloured burn-out effects on textile materials which consist on a mixture of hydrophobic fibres and cellulose fibres, in which one or more disperse dyestuffs for dyeing the hydrophobic fibre portion, if desired together with one or more dyestuffs for dyeing the cellulose portion, are applied to the textile material in the form of a dyeing liquor or print paste, and then carefully dried incipiently or completely, and a burn-out paste is then printed on in the form of a pattern, but the order in which the print paste and the burn-out paste are printed on can also be reversed and if a print paste is used the incipient or intermediate drying can be dispensed with, and the textile material is then heat-treated at temperatures of 100° to 240° C., whereupon one or more, as the case may be, of the cellulose-dyeing dyestuffs become fixed and the textile material is finished.

It has been known for a long time how to prepare burn-out effects on textile materials which consist of a mixture of hydrophobic fibres, for example polyester fibres, and cellulose fibres. Namely, the blend fabric is printed in the form of a pattern with a burn-out paste which contains as burn-out agents actual or potentially strong acids which in a subsequent treatment at a high temperature saccharify or carbonise, that is destroy, the cellulose fibres in the printed areas. The residues of the burnt-out cellulose fibres can be removed from the fabric by means of a simple wash. A textile material is thus obtained which has transparent areas which are arranged in the form of a pattern and which only consist of hydrophobic fibres. Examples of actual or potentially strong acids are sulphuric acid, amidosulphonic acid, sulphonic acids, such as, for example, dibutylnaphthalenesulphonic acid, sodium bisulphate, aluminium sulphate and aluminium chloride. This burn-out method can be combined with a step in which the hydrophobic fibre portion and/or the cellulose portion are dyed.

Various means are known of preparing white or coloured burn-out effects on coloured ground. For example, a polyester/cellulose fibre blend fabric can be dyed with disperse dyestuffs and reactive dyestuffs, either in succession or at the same time with their mixture, and the cellulose portion of the fabric can then be destroyed in areas which form a pattern by printing the fabric with a burn-out agent and, if desired, with a disperse dyestuff which is resistant to this burn-out agent. Should only the cellulose portion have been dyed, for example reactively, then a colourless burn-out paste produces the normal colourless burn-out style fabric. The addition to the burn-out paste of a burn-out-resistant disperse dyestuff has the effect that the polyester portion in a burnt-out area is dyed by this dyestuff.

If only the polyester portion is dyed, by disperse dyestuffs, a colourless burn-out paste substantially increases the depth and brilliance of the colour in a printed area. On the addition to the burn-out paste of a burn-out-resistant disperse dyestuff the hue of this dyestuff and the hue of the ground disperse dyestuff add to each other and give as a rule a dull combined shade.

If only a portion of the blend fabric is dyed in the ground, as in these two cases, the result is that the finished goods have an unsettled, skittery, jeans-like appearance.

Another possibility is to dye the ground with disperse and, for example, reactive dyestuff. In this case a colourless burn-out paste lightens the colour of printed areas; a coloured burn-out paste produces the same addition of hues as in the case where printing took place on goods in which only the polyester portion had been pre-dyed.

Although the ground, which is completely dyed through, has a solid appearance, on the one hand it is impossible to obtain white burn-out effects and on the other, in the case of coloured burn-out effects, the choice of colour is restricted to the addition colour. In other words, it is impossible to obtain clear, in particular yellow, red or blue shades.

It is also possible first to burn out the polyester/cellulose fibre blend fabric in a colourless or coloured pattern and then to cross-dye the polyester and/or cellulose fibre portion of the ground. However, this method is also afflicted with the abovementioned disadvantages, such as unsettled appearance or an addition colour. In principle it is also possible to dye the blend fabric while reserving those areas which are subsequently to be burnt out, as described, for example, in German Offenlegungsschrift No. 2,856,283. However, in this method it is very difficult to prepare sharp, in particular filigree-like patterns especially on a dark ground. Furthermore, the two latter two-stage processes are highly labour-intensive and time-consuming and require substantial expenditure on machinery, and if pre-dyed material is used it is also necessary to run extensive stocks.

The abovementioned disadvantages of known processes for preparing white or coloured burn-out effects on textile materials which consist of a mixture of hydrophobic fibres and cellulose fibres can be overcome when, and this is the inventive step, in the burning-out process described at the outset the dyeing liquor or print paste contains one or more disperse dyestuffs which are dischargeable by the burn-out agent.

Disperse dyestuffs used as disperse dyestuffs which are dischargeable by the burn-out paste have chromophors which are destroyed by the burn-out agents contained in the burn-out pastes and/or are converted by these burn-out agents into forms which no longer exhaust on to the hydrophobic fibres. Examples of dyestuffs which can be discharged in the process according to the invention are azo dyestuffs which are wholly or predominantly in the azo form, naphthalimide dyestuffs, and certain anthraquinone dyestuffs.

Examples of monoazo dyestuffs which can be discharged in the process according to the invention are those having carbocyclic or heterocyclic diazo and/or coupling components from among anilines, naphthylamines, phenols, naphthols or 5- or 6-membered ring heterocyclics which may be benzo-fused. Examples of suitable disazo dyestuffs are those whose central component is derived from anilines, naphthylamines or 5- or 6-membered ring-heterocyclic amines. Examples of dischargeable azo dyestuffs are C.I. Disperse Yellow 7, 23 and 68; C.I. Disperse Orange 1, 3, 5, 13, 18, 19, 20, 21, 25, 29, 30, 33, 38, 44, 55, 61, 66, 71, 81, 96, 127, 128 and 130; C.I. Disperse Red 1, 2, 5, 7, 13, 17, 43, 50, 54, 56, 65, 73, 76, 82, 90, 134, 151, 160, 167, 168, 177, 180, 183, 184, 202, 203, 279, 281, 311, 312 and 324; C.I. Disperse Violet 12, 13, 24, 48, 58, 63 and 33; C.I. Disperse Blue 79, 85, 94, 122, 125, 130, 139, 148, 149, 165, 165/1, 165/2, 171, 183, 284, 287, 290, 295 and 330; C.I. Disperse Brown 1, 4/1 and 19; and C.I. Disperse Green 9.

The dyestuff of the formula

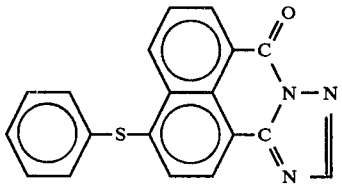

is mentioned as an example of naphthalimide dyestuffs which can be discharged in the process according to the invention.

Examples of anthraquinone dyestuffs which can be discharged in the process according to the invention are those which have one or more carboxylate groups, such as, for example, the dyestuff C.I. Disperse Blue 288.

In the process according to the invention, azo dyestuffs which are wholly or predominantly in the azo form are preferably used as dischargeable disperse dyestuffs.

Examples of disperse dyestuffs which are acid-resistant and hence in the process according to the invention nondischargeable and which can be combined with dischargeable disperse dyestuffs in order to prepare multicoloured designs are anthraquinone, naphthalimide, nitro, quinaphthalone and methine dyestuffs and dyestuffs which have been prepared by azo-coupling and are predominantly in the hydrazone form, such as, for example, azo dyestuffs having 2-hydroxypyrid-6-one derivatives as coupling components. Examples of suitable dyestuffs which are resistant to discharging agent are C.I. Disperse Yellow 63, 114, 180, 54 and 58; C.I. Disperse Orange 146 and 139; C.I. Disperse Red 60, 91, 92 and 132; C.I. Vat Red 41; C.I. Disperse Violet 35; and C.I. Disperse Blue 56 and 87.

In the preparation of white burn-out effects it is also possible to add to the burn-out pastes acid-resistant optical brighteners.

Any dyestuff which is known for dyeing cellulose and which does not stain the hydrophobic fibre portion is suitable for dyeing the cellulose portion of the blend fibre textile material, thus, for example, selected reactive, substantive, vat, leuco vat ester, sulphur or development dyestuffs, of which reactive and substantive dyestuffs are preferably used.

It is also possible to dye the cellulose portion before or after the burning-out process, a washing stage being preferably inserted after the pre-dyeing or before the after-dyeing. The dyestuffs used for dyeing the cellulose portion should stain hydrophobic fibres, in particular polyester fibres, as little as possible. This stipulation applies in particular to the preparation of white burn-out effects. Examples of what is suitable for pre-dyeing the cellulose portion are especially sulphur dyestuffs, but in particular substantive and reactive dyestuffs. Examples of what is suitable for after-dyeing the cellulose portion are especially sulphur, vat and leuco vat ester dyestuffs, but in particular substantive and reactive dyestuffs. Preferably the dyestuffs are applied to the two fibre portions at the same time, that is in the course of the burning-out process. Examples of dyestuffs suitable for this purpose are disperse and substantive dyestuffs, preferably disperse and reactive dyestuffs.

Reactive dyestuffs which are suitable for dyeing the cellulose portion of the blend fibre textile material using the process according to the invention are the known commercial dyestuffs from among the azo, azomethine, quinophthalone, nitro or anthraquinone series which contain one or more fibre-reactive radical of the triazine, quinoxaline, phthalazine, pyridazine, pyrimidine, $\alpha,\beta$-unsaturated aliphatic carboxylic acid or aliphatic phosphonic acid class. Examples of fibre-reactive radicals or of the most important compounds from which fibre-reactive radicals are derived are the 2-fluoro-, 2-chloro- or 2-bromo-ethylsulphonyl radical, the 2-sulphato-, 2-thiosulphato- or 2-phosphato-ethylsulphonyl radical, or their sodium or potassium salts, the 2-sulphatoethylsulphonylamino radical or its sodium or potassium salt, the vinylsulphonyl radical, the 2-chlorovinylsulphonyl radical, cyanuric chloride, cyanuric fluoride, cyanuric bromide, dihalogenoaminotriazines, such as, for example, 2,4-dichloro-6-aminotriazine, 2,4-dichloro-6-(2-hydroxyethylamino)-, 2,4-dichloro-6-methylamino-, 2,4-dichloro-6-phenylamino- or 2,4-dichloro-6-(o-, n- or p-sulphophenyl)-amino-triazine, dihalogenoalkoxy- and -aryloxy-sym.-triazines, tetrahalogenopyrimidines, 2,4,6-trifluoro-5-chloropyrimidine, tetrachloropyrimidine, 2,4,6-trihalogenopyrimidines, tetrachloropyridazine, derivatives of heterocyclic carboxylic or sulphonic acids, such as, for example, 3,6-dichloropyridazine-4-carbonyl chloride, 2,4-dichloropyrimidine-5-carbonyl chloride, 2,4,6-trichloropyrimidine-5-carbonyl chloride, 4,5-dichloro-6-pyridazonylpropionyl chloride, 1,4-dichlorophthalazine-6-carbonyl chloride, 5,6-dichloro-4-methyl-2-methylsulphonylpyrimidine, 2- or 3-monochloroquinoxaline-6-carbonyl chloride or -6-sulphonyl chloride, 2,3-dichloroquinoxaline-6-carbonyl chloride or -6-sulphonyl chloride, 2,4-dichloroquinazoline-6- or -7-carbonyl or -sulphonyl chloride, 2-chlorobenzothiazole-5- or -6-carbonyl chloride or -5- or -6-sulphonyl chloride, 2-methylsulphonyl- or 2-ethylsulphonyl- or 2-phenylsulphonyl-benzothiazole-5- or -6-sulphonyl chloride, 4,5-dichloropyridin-2-one, acryloyl chloride, 3-chloropropionyl chloride, and the phosphonic acid or alkylphosphonic acid radical. Examples of suitable reactive dyestuffs are those reactive dyes listed in the Colour Index which do not stain the hydrophobic fibre portion. Substantive dyestuffs which are suitable for dyeing the cellulose portion of the blend fabric using the process according to the invention are selected known commercial dyestuffs, for example from among monoazo, disazo, trisazo and tetrakisazo dyestuffs and from among condensation dyestuffs, direct dyestuffs having a urea bridge, triazinyl dyestuffs, copper complex dyestuffs, and direct dyestuffs which have to be aftertreated. Examples of suitable substantive dyestuffs are those direct dyes listed in the Colour Index which do not stain the hydrophobic fibre portion.

The burn-out agents used are strong acids or compounds which split off strong acids and which in the subsequent heat treatment destroy the cellulose fibres. Suitable examples are sulphuric acid, amidosulphonic acid, sodium bisulphate, aluminium sulphate, aluminium chloride, dibutylnaphthalenesulphonic acid and p-toluenesulphonic acid, methanesulphonic acid and sulphonic acids from among arenemonosulphonic or arenedisulphonic acids, alkanesulphonic acids having 1 to 8 C atoms, alkenesulphonic acids having 2 to 5 C atoms, cycloalkanesulphonic acids having 5 to 7 C atoms, and N-, O- or S-containing five- or six-membered ring-heterocyclic sulphonic acids. These sulphonic acids can be optionally monosubstituted or polysubstituted, by identical or different substituents in the case of polysubstitution. Examples of suitable substituents are alkyl or alkoxy having 1 to 8 C atoms each, alkenyl having 3 to 5 C atoms, alkylcarbonyl having a total of up to 8 C atoms, optionally substituted phenylcarbonyl, optionally substituted aminocarbonyl, alkoxycarbonyl having a total of up to 9 C atoms, phenoxycarbonyl, cyano, nitro, fluorine, chlorine, bromine, hydroxycarbonyl, aminosulphonyl, alkylsulphonyl having up to 8 C atoms, optionally substituted phenylsulphonyl, alkylsulphinyl having up to 8 C atoms, optionally substituted phenylsulphinyl, phenyl, hydroxyl or acetamino, and thiocyano.

Further suitable burn-out agents are the alkali metal salts of sulphonic acids, in particular the sodium or potassium salts, in combination with sulphuric acid. It is of course also possible to use mixtures of several burn-out agents. Preferable burn-out agents do not attack the hydrophobic fibre portion at all or only very slightly. Preferable burn-out agents are sodium bisulphate, p-toluenesulphonic acid, methane-sulphonic acid and alkylnaphthalenesulphonic acids, possibly mixed with sulphuric acid. The fabric is printed with the burn-out agent as customary in the form of a burn-out paste. A suitable burn-out paste is any formulation which enables the abovementioned burn-out agents to be applied to the fabric and which under the application conditions ensure as level a transfer of the burn-out paste to the fabric as possible and produce as sharp a print as possible. The burn-out agents are preferably added as early as the burn-out pastes are being prepared from the starting constituents. The amount of burn-out agent to be used in the burn-out pastes increases with the cellulose content of the blend fabric, with milder burning-out conditions, with increasing depth of the ground dyeing and with poorer dischargeability of the disperse dyestuffs, and falls with increasing activity of the burn-out agent. Active burn-out agents, such as sulphonic acids, require as a rule burn-out agent concentrations in the burn-out pastes of 5 to 150 g/kg, preferably 50 to 130 g/kg. In the case of less active burn-out agents, such as, for example, sodium bisulphate, concentrations of 20 to 350 g/kg, preferably 80 to 250 g/kg, are normally required to obtain acceptable burn-out style fabrics at the amounts of burn-out paste customarily used and to destroy, by discharging, the dischargeable disperse dyestuffs.

As is usual, the burn-out pastes, in addition to the burn-out agents, also contain water, thickeners and auxiliaries (for example swelling agents, dispersants or carriers) and, if desired, disperse dyestuffs which are resistant to the burn-out agent. Examples of suitable thickeners are starch degradation products, such as dextrin; nonionic starch derivatives, such as British gum, types of gum, such as gum arabic, locust bean flour, in particular locust bean flour ether or tragacanth, guar derivatives, in particular guar ether, and cellulose ether carboxylic acids. Further the burn-out pastes can also contain other customary auxiliaries and additives, such as, for example, hydrotropic substances, and additives which promote wetting, penetration and dyestuff absorption. Particularly favourable is also the presence of nonionic detergents or solubilisers which are advantageously contained in the burn-out pastes, such as, for example, glycerol and/or polyglycols, such as polyethylene glycol, having a mean molecular weight of 300 to 500, and/or polypropylene glycols, as described, for example, in German Offenlegungschrift No. 2,951,312, or products based on N,N-dialkyl-substituted lower carboxamides, such as, for example, N,N-dicyanoethylformamide, and also the presence of agents which prevent foaming and of agents which make it easier to wash out the burnt-out cellulose.

The process according to the invention is carried out on textile materials which consist of a mixture of cellulose fibres and hydrophobic fibres. These hydrophobic fibres can consist of, for example, polypropylene, polyacrylonitrile, polyamide or in particular polyesters. Examples of suitable polyester fibres are those based on polybutylene terephthalate, poly-1,4-cyclohexylene dimethylene terephthalate, but in particular polyethylene terephthalate, which polyesters can also have been modified, for example with a view to easier dyeability, for example by cocondensing other components, for example other dicarboxylic acids and/or other diols. The cellulose content of the blend fabric, in particular of a polyester/cellulose fibre blend fabric, is between 20 and 80% by weight, and is limited by the strength of the fabric still present after the burning-out step and by the degree of transparency desired. A cellulose content of 33 to 66% by weight is preferable.

Fabrics which are particularly suitable for the process according to the invention are made of yarns whose surface consists purely of cellulose fibres. Examples of such yarns are core-spun yarns, whose continuous filament core is surrounded during spinning with cellulose fibres, and core-twist yarns, around whose core fully spun cellulose fibres have been wound. When such a fabric is burnt out the continuous filament becomes visible in some places.

The textile material can be in the form of sheet-like structures, for example in the form of random webs, felts, carpets or woven or weft- or warp-knitted fabric webs or pieces.

To improve the absorbency of the textile material, an adequate degree of absorbency being a prerequisite for the complete penetration of the cellulose fibre with the burn-out agent, the textile material is advantageously pretreated. An example of such a pretreatment is a treatment with alkali at 50° to 110° C. for one hour.

The process according to the invention is carried out by applying one or more of the abovementioned acid-dischargeable disperse dyestuffs and, if desired, one or more of the dyestuffs specific for the dyeing of the cellulose portion in the form of a dyeing liquor or print paste to the textile material. If a dyeing liquor is used the textile material is, for example, impregnated in a manner whichis in itself known, for example it is slop- or nip-padded. This dyeing liquor or print paste can also contain known customary dyeing or printing auxiliaries, such as, for example, dispersants, wetting agents, antifoams and padding auxiliaries. The textile material impregnated with a dyeing liquor is squeezed down to a liquor pick-up of 50 to 120%, and then carefully dried in such a way that the disperse dyestuff does not become fixed in the hydrophobic fibre. This drying can be effected, for example, by means of warm air, possibly with preceding infra red irradiation, the temperature being about 60° to 80° C., at most about 100° C. with a corresponding curtailment of the time. The textile materials thus pretreated are then afterprinted in the desired pattern with one of the abovementioned burn-out pastes. The burn-out paste contains one or more of the abovementioned burn-out agents and customary additives. The impregnated and printed textile materials are then subjected to a heat treatment at between 100° and 240° C., preferably between 150° and 200° C., for, for example, 15 to 360 seconds, preferably 30 to 240 seconds, the treatment being carried out for a short time in the case of relatively high temperatures and for a long time in the case of relatively low temperatures. The heat for this heat treatment is supplied by superheated steam or by hot air. The heat treatment destroys the cellulose portion of the textile material in those areas printed with the burn-out paste, acid-dischargeable disperse dyestuffs are discharged to colourless, and disperse dyestuffs which are resistant to the burn-out agent become fixed in the hydrophobic fibre, and ground disperse dyestuffs and possibly dyestuffs for dyeing the cellulose portion of the ground become fixed in the unprinted areas provided chemicals necessary to fix the latter dyestuff had been added to the padding liquor. If desired it is also possible to fix the latter dyestuff in a second operation, that is after the disperse dyestuffs have become fixed, for example using the two-step method. Finally the goods are rinsed, if desired reduction-cleared in a conventional manner, soaped warm, if appropriate calendered, rinsed, and dried.

The heat treatment can also be carried out by first burning out the cellulose fibres in the lower temperature range and then, at a higher temperature, to discharge the dischargeable disperse dyestuffs and, if desired, simultaneously to fix the dyestuffs which dye the cellulose.

The cellulose content of the textile material which is used can also have been already pre-dyed.

The dyeing liquor, in addition to disperse dyestuffs which are discharged by the burn-out agent, can also contain one or more disperse dyestuffs which are resistant to the burn-out agent and are hence not destroyed by the burn-out pastes.

As already mentioned, it is also possible for the textile material to be printed with the dyestuffs in the form of print pastes and then to be afterprinted with the burn-out paste in the pattern desired. This method does not necessarily require incipient or intermediate drying between the two printing steps, so that it is also possible to work wet-on-wet. The textile prints are then fixed and finished as already described above. In this process also it is possible to add to the dyestuff print paste which is printed on first and which can also contain several disperse dyestuffs of the kind mentioned which are dischargeable to white one or more disperse dyestuffs which are resistant to acid and hence discharging agent. In another way of carrying out the process according to the invention, a burn-out paste of the type mentioned is used which contains one or more disperse dyestuffs which are stable to the burn-out agent.

The process according to the invention can preferably also be carried out by first printing the textile material in a pattern with the burn-out paste, which may contain disperse dyestuffs which are resistant to the burn-out agent, and then afterprinting, wet-on-wet or after a careful incipient or complete drying stage, with a print paste which contains the ground dyestuffs (dyestuffs for the cellulose portion and/or dischargeable and/or non-dischargeable disperse dyestuffs).

it is also possible to dye the ground with a padding liquor or print paste which only contains one or more disperse dyestuffs. In a first process step the fabric web thus padded or printed is burnt out in a pattern white or, if desired, coloured, the disperse dyestuff for the ground becoming fixed. In a second working step the cellulose portion of the blend fabric is dyed with suitable dyestuffs. The areas which have been burnt out beforehand, where the cellulose has been destroyed, remain white or retain the shade of the disperse dyestuffs which are resistant to the burn-out agent.

The disperse dyestuffs are present in the padding liquors, print pastes or burn-out pastes in a highly disperse form, as customarily known for disperse dyestuffs. The padding liquors or print pastes are also prepared in a manner which is in itself known, by mixing the constituents of the liquor or of the print paste with the amount of water necessary and with liquid highly disperse or solid redispersible formulations of the dyestuffs.

In the examples which follow percentages are percentages by weight and parts are parts by weight.

EXAMPLE 1

A polyester/cotton blend fabric (50%:50%) made of a core-spun yarn was padded with the following dye liquor:

10 parts of C.I. Disperse Brown 1,
3 parts of C.I. Reactive Yellow 23,
5 parts of C.I. Reactive Orange 16,
2 parts of C.I. Reactive Blue 122,
25 parts of sodium formate,
10 parts of sodium m-nitrobenzenesulphonate,
20 parts of a padding auxiliary based on polyacrylic acid, and 925 parts of water, and squeezed. The liquor pick-up was 70%. The padded fabric was dried at 80°, and printed in a pattern with a burn-out paste of the following composition:

500 parts of a 5% strength locust bean flour ether thickening,
80 parts of glycerol,
80 parts of polyglycol 400,
100 parts of p-toluenesulphonic acid, and
240 parts of water.

The fabric was then dried at 80° C., and then exposed to a hot-air treatment at 195° C. for 30 seconds, and then rinsed, soaped, and dried. White burn-out effects were obtained on a rosewood-coloured ground.

EXAMPLE 2

Example 1 was repeated with the following dyeing liquor:

60 parts of C.I. Disperse Blue 333,
60 parts of C.I. Reactive Blue 122,
25 parts of sodium formate,
10 parts of sodium m-nitrobenzenesulphonate,
20 parts of a padding auxiliary based on polyacrylic acid, and
825 parts of water, and the following burn-out paste:

500 parts of a 5% strength locust bean flour ether thickening,
80 parts of glycerol,
80 parts of polyglycol 400,
100 parts of sodium bisulphate,
60 parts of the liquid commercial form of the dyestuff of the formula

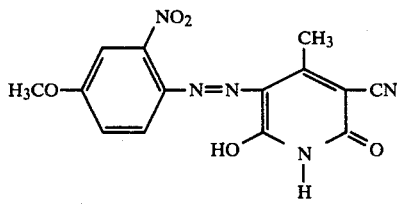

180 parts of water, affording after a 40 second 190° C. hot-air treatment a print on navy blue ground in which the printed areas were burnt out and had an orange colour.

EXAMPLE 3

. Example 1 was repeated with the following dyeing liquor:

5 parts of C.I. Disperse Blue 165,
25 parts of C.I. Direct Blue 213,
10 parts of sodium m-nitrobenzenesulphonate,
20 parts of a padding auxiliary based on polyacrylic acid, and
940 parts of water, affording white burn-out effects on blue ground.

EXAMPLE 4

A polyester/viscose blend fabric (70%:30%) was padded with the following padding liquor:

30 parts of C.I. Disperse Orange 71,
20 parts of sodium formate,
20 parts of a padding auxiliary based on polyacrylic acid,
10 parts of sodim m-nitrobenzenesulphonate, and
920 parts of water, and then squeezed.

The liquor pick-up was 70%. The impregnated goods were dried at between 80° and 100° C., and printed with the following burn-out paste:

100 parts of p-toluenesulphonic acid,
240 parts of water,
500 parts of a 5% strength locust bean flour ether thickening,
80 parts of glycerol, and
80 parts of polyglycol 400.

Printing and drying were followed by heat-setting at 200° C. for 1 minute, and then reduction clearing, rinsing, and soaping. The cotton portion not burnt out was then dyed by the pad-steam method. For this purpose the fabric was padded at room temperature with the following dyeing liquor (per liter):

20 g of C.I. Vat Orange 7,
10 g of a padding auxiliary based on polyacrylic acid, and
2 g of a padding auxiliary consisting of anionic and non-ionic components, and squeezed to a liquor pick-up of 70%. The fabric was then dried at 80° to 100° C., padded with a liquor of 40 g/l hydrosulphite and 60 g/l 38 Bé sodium hydroxide solution, for pad-steam developing, and steamed at 102° to 105° C. for 1 minute. The fabric was rinsed and then oxidised in a bath containing per liter 2 g of $H_2O_2$, rinsed, soaped, rinsed, and dried. White burn-out effects were obtained on orange ground.

EXAMPLE 5

A polyester/viscose staple blend fabric (50%:50%) was padded with the following dyeing liquor:

60 parts of C.I. Disperse Blue 333,
60 parts of C.I. Reactive Blue 122,
10 parts of sodium m-nitrobenzenesulphonate,
20 parts of a padding auxiliary based on polyacrylic acid, and
850 parts of water, squeezed down to a liquor pick-up of 70%, and dried at 80° C. The impregnated goods were then printed in the form of a pattern with the following burn-out paste:

500 parts of a 5% strength locust bean flour thickening,
80 parts of glycerol,
80 parts of polyglycol 400,
150 parts of sodium bisulphate,
60 parts of the liquid commercial form of the dyestuff of the formula

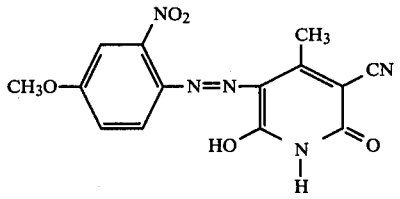

130 parts of water, and dried at 80° C. The fabric was then heat-treated at 200° C. for 40 seconds. Thereafter the reactive dyestuff content was fixed using the cold-batch method. For this purpose the goods were cold-padded with the following liquor:

100 parts of 38° Bé sodium hydroxide solution,
150 parts of calcined sodium carbonate,
50 parts of potassium carbonate,
150 parts of sodium chloride, and
550 parts of water, and stored at room temperature for 4 hours, and then rinsed, neutralised, and dried. Orange burn-outs were obtained on navy blue ground.

EXAMPLE 6

A polyester/cotton blend fabric (65%:35%) was padded in a manner similar to Example 1 with the following dyeing liquor:

20 parts of C.I. Disperse Yellow 68,
10 parts of the dyestuff of the formula

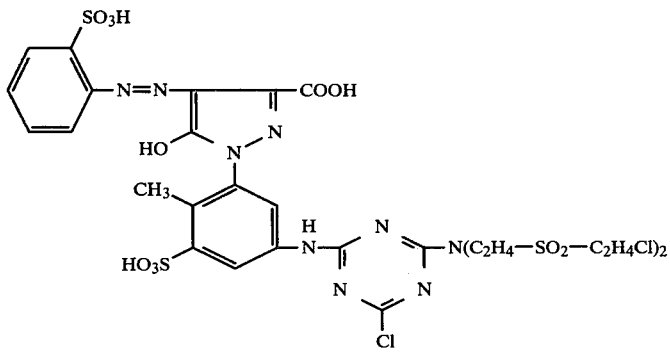

20 parts of sodium formate,
20 parts of a padding auxiliary based on polyacrylic acid, and
930 parts of water, dried at 80° C., and printed in the form of a pattern with the following burn-out paste:

500 parts of a 5% strength locust bean flour ether thickening,
80 parts of glycerol,
80 parts of polyglycol 400,
90 parts of burn-out agent based on an alkylnaphthalenesulphonic acid mixture,
20 parts of padding auxiliary based on a fatty acid polyglycol ester, and
230 parts of water.

The fabric was dried at 80° C. and was then exposed to a hot-air treatment at 200° C. for 30 seconds, and then rinsed, soaped, and dried. White burn-out effects were obtained on a yellow ground.

EXAMPLE 7

A polyester/cotton blend fabric made of a core-spun yarn (50%:50%) was printed in the form of a pattern with the following burn-out paste:

500 parts of a 5% strength locust bean flour ether thickening,
80 parts of glycerol,
80 parts of polyglycol 400,
140 parts of an alkylnaphthalenesulphonic acid mixture, and 200 parts of water, and afterprinted without intermediate drying with the following paste:

20 parts of C.I. Disperse Brown 1,
4.5 parts of C.I. Reactive Yellow 23,
7.5 parts of C.I. Reactive Orange 16,
3 parts of C.I. Reactive Blue 122,
365 parts of water,
400 parts of a 4% strength alginate thickening,
100 parts of a 10% strength starch ether thickening,
5 parts of a polyphosphate-based water-softening agent,
10 parts of sodium 3-nitrobenzenesulphonate,
2 parts of monosodium phosphate, and
83 parts of water or thickening.

The printed fabric was then dried at 80° C., and exposed to a hot-air treatment at 200° C. for 40 seconds. The reactive dyestuff content was then fixed using the cold-batch method. For this purpose the print was cold-padded with the following liquor and stored at room temperature for 4 hours:

100 parts of 38° Be sodium hydroxide solution,
150 parts of sodium carbonate,
50 parts of potassium carbonate,
150 parts of sodium chloride, and
550 parts of water.

The fabric was finally rinsed, neutralised, soaped, and dried.

White burn-out effects were obtained on brown ground.

In the examples the dyestuffs were used in their liquid commercial forms.

What is claimed is:

1. In the process for preparing white or colored burn-out effects on textile materials containing hydrophobic fibers and cellulose fibers which comprises applying to the material a dyeing liquor or printing paste containing at least one disperse dyestuff for dyeing the hydrophobic fibers alone or mixed with dyestuff for dyeing the cellulose fibers, applying a burn-out agent which is a strong acid or an agent which splits off strong acid to the textile material in the form of a pattern, and then heat-treating the textile material at about 100° to 240° C. whereby the dyestuff is fixed and the burn-out effect is produced, the improvement comprises said dyeing liquor or print paste contains at least one disperse dyestuff which is discharged by the burn-out agent.

2. The process according to claim 1 wherein the burn-out agent contains at least one nondischargeable disperse dyestuff.

3. The process according to claim 1 wherein the textile material contains cellulose fibers which are predyed.

4. The process according to claim 1 wherein after the burn-out effect is produced, the remaining cellulose fibers are dyed.

5. The process according to claim 1 wherein said hydrophobic fibers are polyester fibers.

6. The process according to claim 1 wherein the heat treatment step is at 100° to 200° C.

7. The process according to claim 1 wherein the burn-out agent is p-toluenesulphonic acid.

8. The process according to claim 1 wherein the disperse dyestuffs which are dischargeable by the burn-out agent are disperse azo dyestuffs.

9. The process according to claim 1 wherein the dyestuffs for the cellulose portion are reactive dyestuffs or substantive dyestuffs.

10. The process according to claim 1 wherein the burn-out agent is applied as a paste which also contains glycerol, polyglycols, or a mixture thereof.

11. The process according to claim 1 wherein the dyeing liquor or printing paste is applied to the textile material before applying the burn-out agent.

12. The process according to claim 1 wherein the burn-out agent is applied to the textile material before applying the dyeing liquor or printing paste.

* * * * *